US008095061B2

(12) United States Patent
Fujii

(10) Patent No.: US 8,095,061 B2
(45) Date of Patent: Jan. 10, 2012

(54) IMAGE FORMING UNIT HAVING CONVEYING MEMBERS FOR CONVEYING WASTE DEVELOPER AND IMAGE FORMING APPARATUS

(75) Inventor: Masashi Fujii, Tokyo (JP)

(73) Assignee: Oki Data Corporation, Tokyo (JP)

( * ) Notice: Subject to any disclaimer, the term of this patent is extended or adjusted under 35 U.S.C. 154(b) by 666 days.

(21) Appl. No.: 12/232,863

(22) Filed: Sep. 25, 2008

(65) Prior Publication Data

US 2009/0110456 A1 Apr. 30, 2009

(30) Foreign Application Priority Data

Oct. 30, 2007 (JP) ..... 2007-282095

(51) Int. Cl.
*G03G 21/00* (2006.01)

(52) U.S. Cl. ..... 399/358

(58) Field of Classification Search ..... 399/358, 399/360
See application file for complete search history.

(56) References Cited

U.S. PATENT DOCUMENTS

| | | | | |
|---|---|---|---|---|
| 5,956,556 | A * | 9/1999 | Nakajima et al. | 399/358 |
| 7,813,692 | B2 * | 10/2010 | Nakatake | 399/358 |
| 7,917,077 | B2 * | 3/2011 | Shimizu et al. | 399/360 |
| 7,945,203 | B2 * | 5/2011 | Shimizu et al. | 399/360 |

FOREIGN PATENT DOCUMENTS

| | | |
|---|---|---|
| JP | 2-178681 | 7/1990 |
| JP | 2-117565 | 9/1990 |
| JP | 11-073078 | 3/1999 |
| JP | 2001-060054 | 3/2001 |

* cited by examiner

*Primary Examiner* — William J Royer
(74) *Attorney, Agent, or Firm* — Rabin & Berdo, PC

(57) ABSTRACT

In an image forming unit or an image forming apparatus, there is an image carrying body, then, a cleaning member is furnished along the image carrying body to remove developer remaining on the surface of the image carrying body after transferring; a first conveying member conveys the developer removed by the cleaning member to a conveying section formed on one end of the image forming unit, as waste developer; and a second conveying member conveys the waste developer conveyed from the conveying section to a waste developer collecting section. Further, the first conveying member has a developer pushing section which changes a conveyance direction in the conveying section and conveys the waste developer toward the second conveying member.

13 Claims, 11 Drawing Sheets

IMAGE FORMING UNIT HAVING CONVEYING MEMBERS FOR CONVEYING WASTE DEVELOPER AND IMAGE FORMING APPARATUS

FIELD OF THE INVENTION

The invention relates to an image forming unit and an image forming apparatus.

BACKGROUND OF THE INVENTION

Conventionally, in an image forming apparatus such as a printer, copying apparatus, facsimile apparatus, multi-function apparatus or the like, for example, in a printer, the surface of a photosensitive drum is charged by a charging roller, and is exposed by a LED head, so that an electrostatic latent image is formed; then, toner, as developer that is formed on a developing roller in thin film state, is stuck to the electrostatic latent image, so that a toner image is formed; further, the toner image is transferred onto print paper by a transferring roller and is fixed by a fixing device, so that an image is formed.

The toner remaining on the surface of the photosensitive drum after transferring, as waste toner, is removed by a cleaning blade or the like, and is conveyed to a conveying section through a conveyance spiral. Then, the waste toner is further conveyed to a waste toner collecting section by a conveyance belt furnished on the conveying section (for example, refer to patent document 1 of Japan patent publication Heil1-073078)

However, in the conventional technology, the image forming apparatus has such a structure in which the toner conveyed by the conveying section easily accumulates. Thereby, the durability of an image forming unit is low.

SUMMARY OF THE INVENTION

It is, therefore, an objective of the invention to heighten the durability of an image forming unit.

An aspect of the invention is to provide an image forming unit, the image forming unit comprises an image carrying body; a cleaning member which is furnished along the image carrying body to remove developer remaining on the surface of the image carrying body after transferring; a first conveying member which conveys the developer removed by the cleaning member to a conveying section formed on one end of the image forming unit, as waste developer; and a second conveying member which conveys the waste developer conveyed from the conveying section to a waste developer collecting section, wherein the first conveying member has a developer pushing section which changes a conveyance direction in the conveying section and conveys the waste developer toward the second conveying member.

Another aspect of the invention is to provide an image forming apparatus, the image forming apparatus, comprises an image forming unit. The image forming unit includes an image carrying body; a cleaning member which is furnished along the image carrying body to remove developer remaining on the surface of the image carrying body after transferring; a first conveying member which conveys the developer removed by the cleaning member to a conveying section formed on one end of the image forming unit, as waste developer; and a second conveying member which conveys the waste developer conveyed from the conveying section to a waste developer collecting section, wherein the first conveying member has a developer pushing section which changes a conveyance direction in the conveying section and conveys the waste developer toward the second conveying member.

DETAILED DESCRIPTION OF THE PREFERRED EMBODIMENTS

Embodiments of the invention will be described in detail hereinbelow with reference to the drawings. In embodiments, as an image forming apparatus, a printer is adopted and is explained.

Embodiment 1

Figure 2:
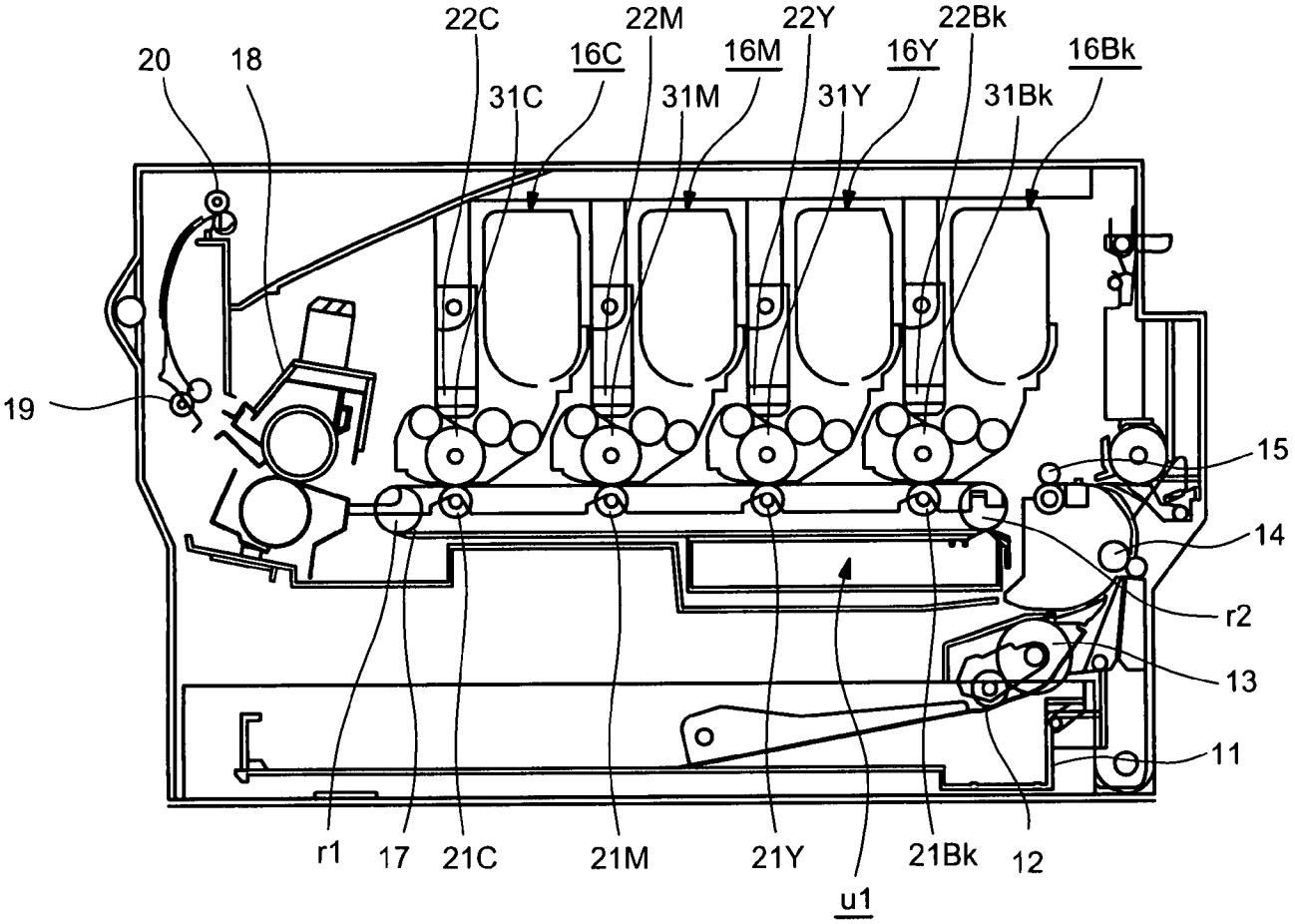
FIG. 2 is a summary diagram of a printer in embodiment 1 of the present invention.

FIG. 2 is a summary diagram of a printer in embodiment 1 of the present invention.

As shown by FIG. 2, on an underside part, of a printer, a paper feeding cassette 11 is furnished as a medium accommodating section, in the paper feeding cassette 11, papers (not shown) are accommodated as a medium. To adjoin the front edge of the paper feeding cassette 11, a paper feeding mechanism is furnished for separating paper one by one and feeds the paper. The paper feeding mechanism has a paper feeding roller 12 and a separating roller 13. After the paper fed by the paper feeding mechanism, is conveyed by a conveying roller 14 furnished on the upside, and is further conveyed by a conveying roller 15, the paper is supplied to image forming units (ID unit) 16Bk, 16Y, 16M, 16C that serve as image forming sections to form images of respective colors of black, yellow, magenta, cyan.

In the image forming units (ID unit) 16Bk, 16Y, 16M, 16C, photosensitive drums 31Bk, 31Y, 31M, 31C are respectively furnished as image carrying bodies. LED heads 22Bk, 22Y, 22M, 22C are furnished as exposing devices that expose respectively the surfaces of the photosensitive drums 31Bk, 31Y, 31M, 31C to form electrostatic latent images serving as latent images, the LED heads 22Bk, 22Y, 22M, 22C adjoin respectively the image forming units 16Bk, 16Y, 16M, 16C and face respectively to the photosensitive drums 31Bk, 31Y, 31M, 31C.

Further, along the respective image forming units 16Bk, 16Y, 16M, 16C, a transferring unit u1 is furnished. The transferring unit u1 includes a driving roller r1; a driven roller r2; a conveyance belt 17 that, as a conveyance member, is extended between the driving roller r1 and the driven roller r2 and is furnished to freely move; and transferring rollers 21Bk, 21Y, 21M, 21C that, as transferring members, are furnished to face respectively to photosensitive drums 31Bk, 31Y, 31M, 31C so as to sandwich the conveyance belt 17 with the photosensitive drums 31Bk, 31Y, 31M, 31C.

The paper is conveyed with the movement of the conveyance belt 17, passes through between the image forming units 16Bk, 16Y, 16M, 16C and the transferring rollers 21Bk, 21Y, 21M, 21C. The transferring rollers 21Bk, 21Y, 21M, 21C sequentially transfer respective toner images in overlapping form so as to form a color toner image. The respective toner images serve as developer images of respective colors formed in the image forming units 16Bk, 16Y, 16M, 16C.

Continuously, the paper is conveyed to a fixer 18 serving as a fixing device. In the fixer 18, the color toner image is fixed on the paper and a color image is formed. Then, the paper sent out from the fixer 18, is conveyed by a conveying roller 19 and is ejected to the external of the printer by an ejection use conveying roller 20.

Next is to explain the image forming units 16Bk, 16Y, 16M, 16C. Moreover, because the image forming units 16Bk, 16Y, 16M, 16C have identical structure, instead of the explanation of the image forming units 16Bk, 16Y, 16M, 16C, only the image forming unit 16Bk is explained.

Figure 3:
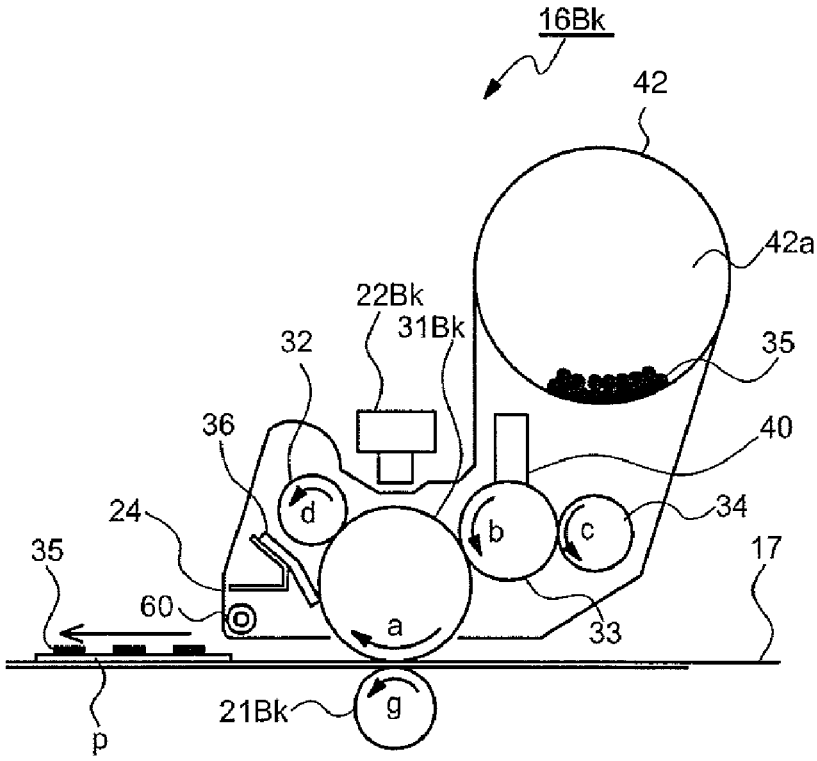
FIG. 3 is a concept diagram for explaining operation of an image forming unit in embodiment 1 of the present invention.

FIG. 3 is a concept diagram for explaining operation of an image forming unit in embodiment 1 of the present invention.

As shown by FIG. 3, there are an image forming unit 16Bk; a transferring roller 21Bk which can rotate along a direction of an arrow "g"; a box body 24; a conveyance belt 17; a photosensitive drum 31Bk which uses a photosensitive body of organic series and can rotate along a direction of an arrow "a" in a predetermined rotation speed, whose surface is charged by charge and on whose surface the charge is removed by exposure; a charging roller 32 which, as a charging device to provide a predetermined voltage, contacts with the surface of the photosensitive drum 31Bk in a certain pressure, can rotate along a direction of an arrow "d"; a LED head 22Bk which is furnished as facing to the photosensitive drum 31Bk and is used for forming an electrostatic latent image onto the surface of the photosensitive drum 31Bk; a developing roller 33 which, as a developer carrying body, can rotate along a direction of an arrow "b"; a toner supplying roller 34 which, as a developer supplying and collecting body, can rotate along a direction of an arrow "c"; toner 35 serving as developer; a developing blade 40 serving as developer regulating member; and a cleaning blade 36 which, as a cleaning member, contacts with the surface of the photosensitive drum 31Bk in a predetermined pressure. The developing roller 33, the toner supplying roller 34 and the developing blade 40 constructs a developing device. Further, the charging roller 32 can rotate in the same direction as the photosensitive drum 31Bk.

Furthermore, there is a toner accommodating unit 42 which, as a developer accommodating container to accommodate the toner 35, is furnished on the upside of the developing device, the toner 35 is supplied from a toner accommodating room 42*a* which, as a developer accommodating room, is furnished in the toner accommodating unit 42.

Then, the toner supplying roller 34 contacts to the developing roller 33 in a certain pressure, and supplies the toner 35 to the developing roller 33 from the toner accommodating room 42*a* via a toner supply opening (not shown) serving as a developer supply opening. Further, the developing blade 40 regulates the toner 35 that is supplied from the toner supplying roller 34 to the developing roller 33 to keep in a certain thickness on the developing roller 33. Then, the developing roller 33 is contacted with the photosensitive drum 31Bk in a certain pressure and develops an electrostatic latent image formed by the LED head 22Bk.

Moreover, the toner 35 that can not move to the paper p while transferring and remains on the surface of the photosensitive drum 31Bk is removed by the cleaning blade 36 furnished along the photosensitive drum 31Bk. That is, the toner 35 is scraped from the photosensitive drum 31Bk, and the scraped toner 35, as waste toner, also as waste developer, is conveyed to a conveying section of a side frame that is furnished on one end of the photosensitive drum 31Bk through a conveyance spiral 60 serving as a first conveying member formed in spiral shape.

Figure 4:
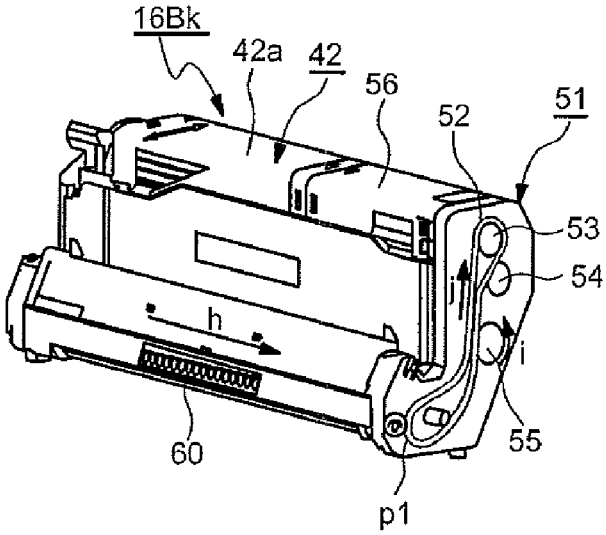
FIG. 4 is a cubic diagram showing an image forming unit in embodiment 1 of the present invention.

FIG. 4 is a cubic diagram showing an image forming unit 16Bk in embodiment 1 of the present invention.

As shown by FIG. 4, the conveyance spiral 60 is furnished along an axis direction of the photosensitive drum 31Bk (FIG. 3). The conveyance spiral 60 is rotated to convey the waste toner along a direction of an arrow "h" through driving a conveyance use motor (not shown) serving as a conveyance use driving section, so that the waste toner is sent toward a side frame 51 of the image forming unit 16Bk.

In the side frame 51, an endless conveyance belt 52, as a second conveying member, is furnished to freely move, on the external surface of the conveyance belt 52, plural teeth are formed according to a certain pitch, these teeth are fit on a gear 55. Then, when the conveyance use motor is driven and the gear 55 is rotated along a direction of an arrow "i", the conveyance belt 52 is moved along a direction of an arrow "j". Thereby, the waste toner conveyed by the conveyance spiral 60 is sent to a conveying section p1 formed on one end i.e. formed in the side frame 51; and enters the conveyance belt 52 in the conveying section p1; is conveyed continuously by the conveyance belt 52; and is ejected to a waste toner collecting room 56 that serves as a waste developer collecting section in the toner accommodating unit 42, through an ejection spiral 54. Moreover, there is a pulley 53 that is a guiding member to guide the conveyance belt 52.

In the embodiment, the toner accommodating room 42*a* and the waste toner collecting room 56 are furnished as adjoining each other left and right along a lengthways direction of the toner accommodating unit 42. However, it is possible to furnish a toner accommodating room 42*a* at a front side of the image forming unit 16Bk in a conveyance direction of the paper p and to furnish a waste toner collecting room 56 at back side of the image forming unit 16Bk in a conveyance direction of the paper p.

Next is to explain a conveyance spiral 50 in the present invention.

Figure 5:
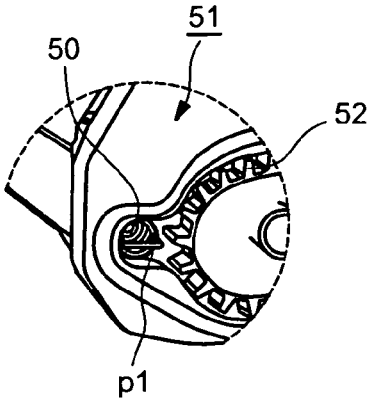
FIG. 5 is a cubic diagram showing a main part of an image forming unit in embodiment 1 of the present invention.
Figure 6:
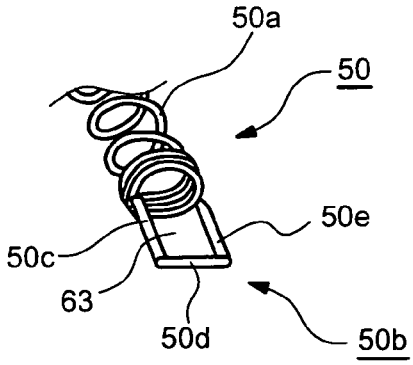
FIG. 6 is a cubic diagram showing an end portion of a conveyance spiral in embodiment 1 of the present invention.
Figure 7:
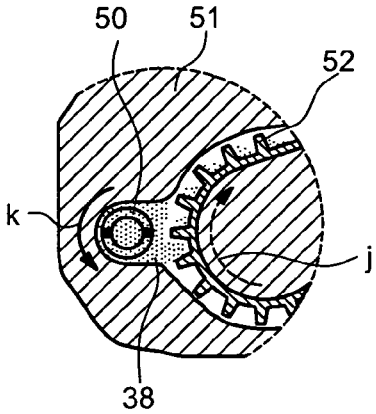
FIG. 7 is a first diagram showing operation of a conveyance spiral in embodiment 1 of the present invention.

FIG. 5 is a cubic diagram showing a main part of an image forming unit in embodiment 1 of the present invention; FIG. 6 is a cubic diagram showing an end portion of a conveyance spiral in embodiment 1 of the present invention; FIG. 7 is a first diagram showing operation of a conveyance spiral 50 in embodiment 1 of the present invention; and FIG. 8 is a second diagram showing operation of a conveyance spiral 50 in embodiment 1 of the present invention.

According to embodiment 1, as shown by drawings, in the conveying section p1, the conveyance spiral 50 which is rotated along a direction of an arrow "k" and the conveyance belt 52 are furnished as an end portion of the conveyance spiral 50 is facing to the conveyance belt 52. The conveyance spiral 50 has an end portion bend part 50*b* formed through bending a spiral portion 50*a* forming the substance body of the conveyance spiral 50 and one end of the spiral portion 50*a*, that is, formed through bending an extension portion of the spiral portion 50*a*. The end portion bend part 50*b* includes a first straight line part 50*c* that extends from the spiral portion 50*a*; a second straight line part 50*d* that extends in an angle of approximate 90o with respect to the first straight line part 50*c*; and a third straight line part 50*e* that extends in an angle of approximate 90o with respect to the second straight line part 50*d* and extends as approximately being parallel with the first straight line part 50*c*. Then, a surrounding portion 63 is formed in a rectangle shape which is formed by a surrounding of the end portion bend part 50*b*.

Figure 8:
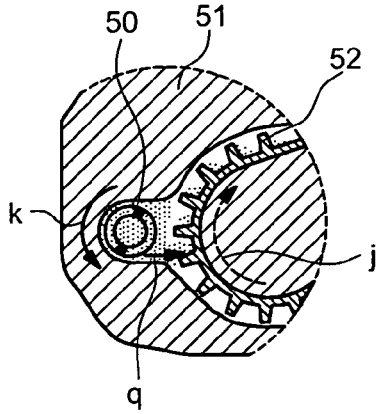
FIG. 8 is a second diagram showing operation of a conveyance spiral in embodiment 1 of the present invention.

In the case, when waste toner 38 is conveyed to the conveying section p1, the end portion bend part 50*b* of the conveyance spiral 50 which is rotated along a direction of an arrow "k" pushes out the waste toner 38 along a direction of an arrow "q" shown by FIG. 8. The end portion bend part 50*b* is a developer pushing section, also is a first developer pushing member. Therefore, the waste toner 38 that has reached the conveying section p1 is sent into the conveyance belt 52 which moves along a direction of an arrow "j". That is, the end portion bend part 50*b*, as a developer pushing section, pushes out the waste toner 38 that is developer having reached the conveying section p1, toward the conveyance belt 52.

As stated above, in the embodiment, because the waste toner 38 can be sent into the conveyance belt 52 in conveying section p1, it is possible to prevent the waste toner 38 from accumulating in the conveying section p1. Therefore, it is possible to reduce load supplied to conveyance use motor used for driving the conveyance spiral 50 to rotate and drive the conveyance belt 52 to move so as to convey the waste toner 38. Thus, not only is it possible to heighten conveyance efficiency; but also it is possible to prevent that the toner solidifies due to an excessive accumulation so that the conveyance spiral 50 can not rotate, and to prevent that member of a rotation transmission system is damaged. As a result, the durability of the image forming unit can be heightened.

Embodiment 2

Next is to explain embodiment 2. Moreover, regarding the same component as that in embodiment 1, the same symbol will be assigned; regarding the same effect of the present invention, obtained by a same structure, it will be applied as an effect of embodiment.

Figure 1:
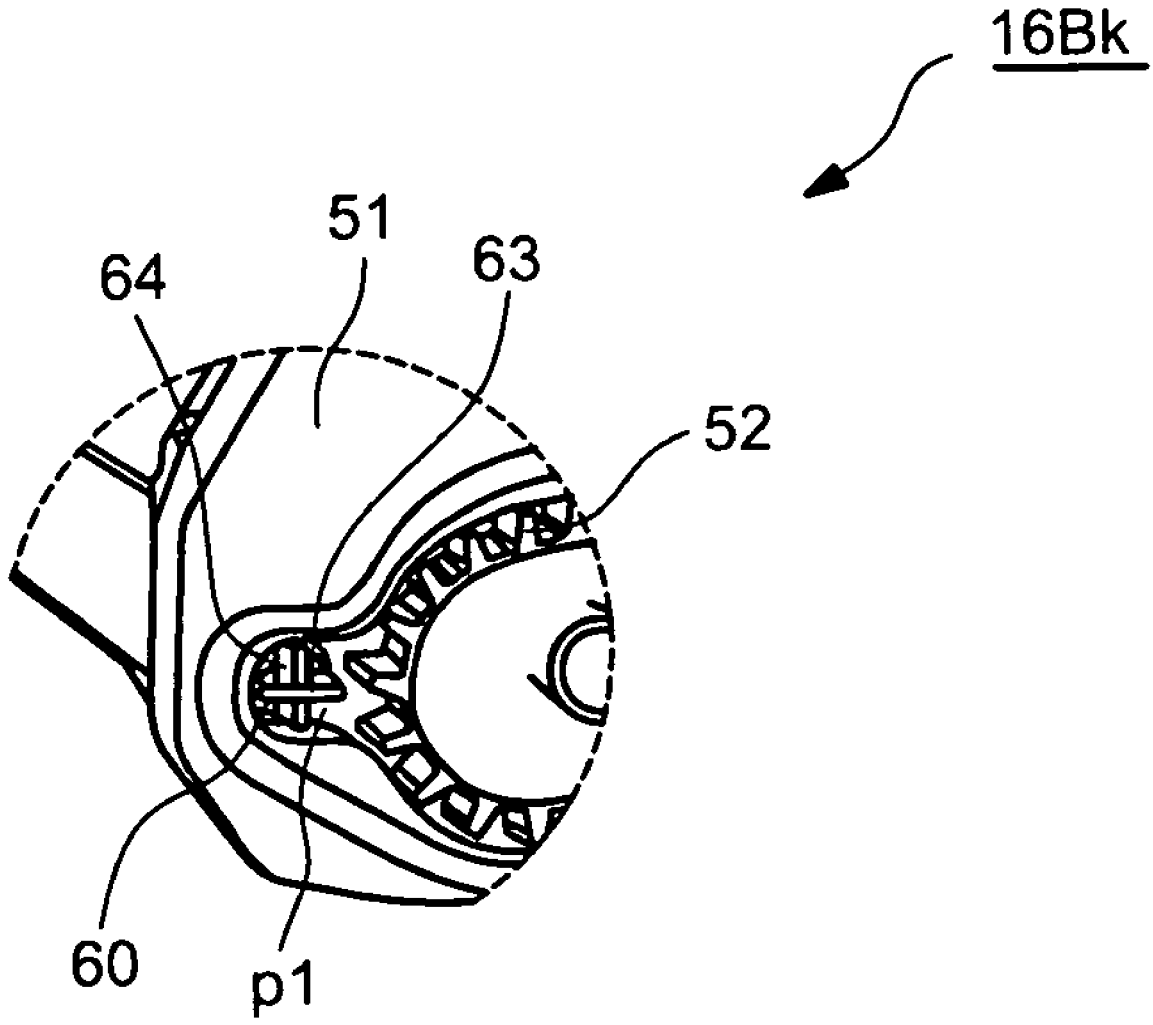
FIG. 1 is a cubic diagram showing a main part of an image forming unit in embodiment 2 of the present invention.
Figure 9:
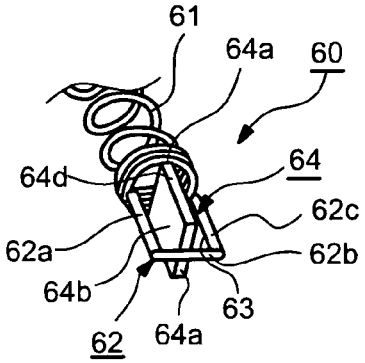
FIG. 9 is a cubic diagram showing an end portion of a conveyance spiral in embodiment 2 of the present invention.
Figure 10:
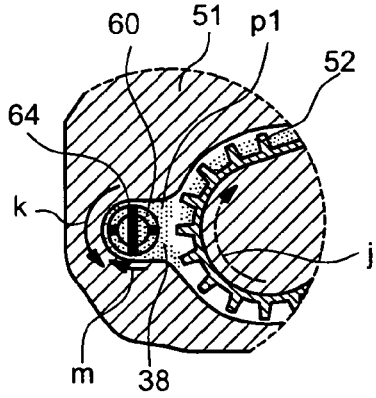
FIG. 10 is a first diagram showing operation of a conveyance spiral in embodiment 2 of the present invention.
Figure 11:
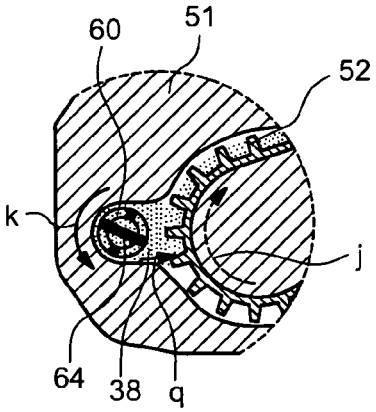
FIG. 11 is a second diagram showing operation of a conveyance spiral in embodiment 2 of the present invention.
Figure 12:
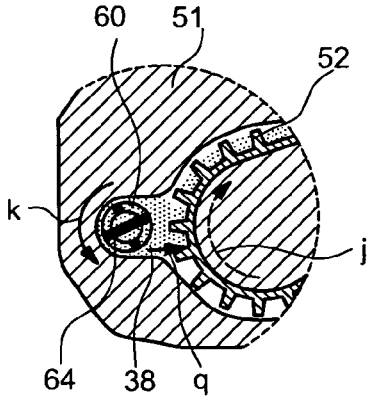
FIG. 12 is a third diagram showing operation of a conveyance spiral in embodiment 2 of the present invention.
Figure 13:
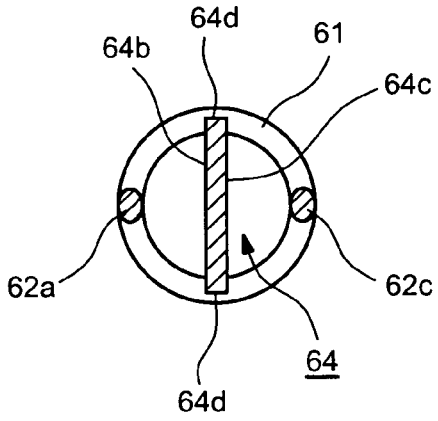
FIG. 13 is a first diagram showing a furnishing state of a board shape member toward a conveyance spiral in embodiment 2 of the present invention.
Figure 14:
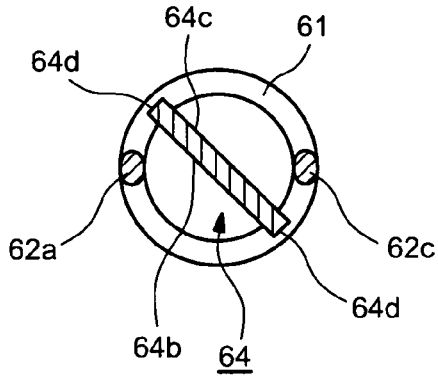
FIG. 14 is a second diagram showing a furnishing state of a board shape member toward a conveyance spiral in embodiment 2 of the present invention.
Figure 15:
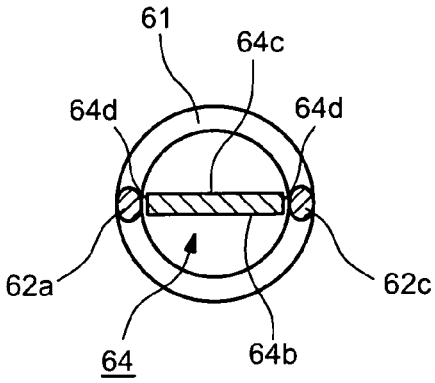
FIG. 15 is a third diagram showing a furnishing state of a board shape member toward a conveyance spiral in embodiment 2 of the present invention.

FIG. 1 is a cubic diagram showing a main part of an image forming unit 16Bk in embodiment 2 of the present invention; FIG. 9 is a cubic diagram showing an end portion of a conveyance spiral 60 in embodiment 2 of the present invention; FIG. 10 is a first diagram showing operation of a conveyance spiral 60 in embodiment 2 of the present invention; FIG. 11 is a second diagram showing operation of a conveyance spiral 60 in embodiment 2 of the present invention; FIG. 12 is a third diagram showing operation of a conveyance spiral 60 in embodiment 2 of the present invention; FIG. 13 is a first diagram showing a furnishing state of a board shape member 64 toward a conveyance spiral 60 in embodiment 2 of the present invention; FIG. 14 is a second diagram showing a furnishing state of a board shape member 64 toward a conveyance spiral 60 in embodiment 2 of the present invention; and FIG. 15 is a third diagram showing a furnishing state of a board shape member 64 toward a conveyance spiral 60 in embodiment 2 of the present invention.

As shown by drawings, the conveyance spiral 60 has an end portion bend part 62 which, as a first developer pushing member, is formed through bending a spiral portion 61 forming the substance body of the conveyance spiral 60 and one end of the spiral portion 61. The end portion bend part 62 includes a first straight line part 6*a* that extends from the spiral portion 61; a second straight line part 62*b* that extends in an angle of approximate 90° with respect to the first straight line part 62*a*; and a third straight line part 62*c* that extends in an angle of approximate 90° with respect to the second straight line part 62*b* and extends as approximately being parallel with the first straight line part 62*a*.

Then, on a surrounding portion 63 which is formed in a rectangle shape which is formed by a surrounding of the end portion bend part 62, a board shape member 64 is furnished as a rotation supply member, also as a second developer pushing member. Two edge portions 64*a* of the board shape member 64 are respectively fixed on the second straight line part 62*b* and the end part of the spiral portion 61 by adhesive (not shown) and the like.

The board shape member 64 has a rectangle shape, and is formed by resin with a small bend character and a high stiffness, such as polystyrene resin containing glass fiber. Moreover, the board shape member 64 has a greater sending force toward the conveyance belt 52 when the board shape member 64 does not bend along a converse direction (i.e. a direction of an arrow "m").

That is, when the conveyance spiral 60 is rotated along a direction of an arrow "k" to convey the waste toner 38, the waste toner 38 is conveyed to the end portion of the conveyance spiral 60 and reaches the neighborhood of the conveying section p1.

Then, because the conveyance spiral 60 rotates, the end portion bend part 62 rotates and the board shape member 64 rotates. Therefore, in the conveying section p1, the conveyance direction of the waste toner 38 is changed, and the waste toner 38 is pushed out along a direction of an arrow "q" shown by FIG. 11. Thereby, it is possible to correctly send the waste toner 38 toward the conveyance belt 52.

That is, a developer pushing section is formed by the end portion bend part 62 and the board shape member 64, and the waste toner 38 that has reached the neighborhood of the conveying section p1 is pushed out toward the conveyance belt 52 through the end portion bend part 62 and the board shape member 64.

Moreover, even if the waste toner 38 solidifies in the conveying section p1, because the end portion bend part 62 breaks up the waste toner 38, the waste toner 38 that has solidified does not hit the board shape member 64.

Thus, in the embodiment, because the waste toner 38 can be conveyed toward the conveyance belt 52 in the conveying section p1, it is possible to prevent the waste toner 38 from accumulating in the conveying section p1. Therefore, it is possible to lighten a load provided to a conveyance use motor for rotating the conveyance spiral 60, moving the conveyance belt 52 or conveying the waste toner 38; and it is possible to improve conveyance efficiency; further, it is possible to prevent that the waste toner 38 that has excessively accumulated solidifies, that the conveyance spiral 60 can not be rotated, and that a member of a rotation transmission system is damaged. Thereby, it is possible to heighten durability of the image forming unit 16Bk.

As shown by FIG. 13 and FIG. 14, in the board shape member 64, it is desirable to form a plane portion 64*b* in a predetermined position to face to the first straight line part 62*a*, as a first sending plane; and to form a plane portion 64*c* in a predetermined position to face to the third straight line part 62*c*, as a second sending plane. In the case, not only is it possible to sufficiently send the waste toner 38 toward the conveyance belt 52 through the board shape member 64, but also it is possible to heighten an effect to break up the waste toner 38 having solidified through the first straight line part 62*a* and the third straight line part 62*c* in the conveying section p1.

As compared with the above stated case, as shown by FIG. 15, in the case that the plane portion 64*b* and the plane portion 64*c* do not respectively face to the first straight line part 62*a* and the third straight line part 62*c*, the board shape member 64 is furnished so that the plane portion 64*b* and the plane portion 64*c* are in parallel with a plane formed by the first straight line part 62*a* and the third straight line part 62*c*, though it is possible to sufficiently send the waste toner 38 toward the conveyance belt 52 through the board shape member 64, a function drops to break up the waste toner 38 through the first straight line part 62*a* and the third straight line part 62*c* in the conveying section p1. Moreover, in the case, side ends 64*d* of the board shape member 64 are placed as respectively facing to the first straight line part 62*a* and the third straight line part 62*c*.

Transformation Example of Embodiment 2

Next is to explain a transformation example of embodiment 2 of the present invention. Moreover, regarding the same component as that in embodiments 1 and 2, the same symbol will be assigned; regarding the same effect of the present invention, obtained by a same structure, it will be applied as an effect of the transformation example.

Figure 16:
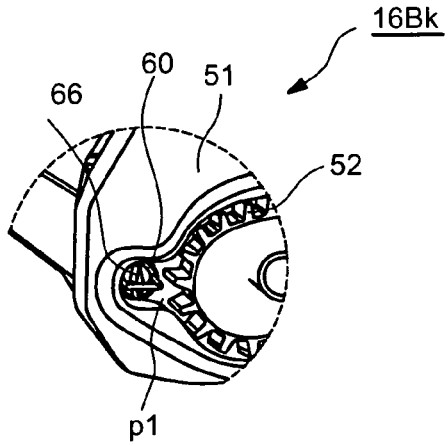
FIG. 16 is a cubic diagram showing a main part of an image forming unit in a transformation example of embodiment 2 of the present invention.
Figure 17:
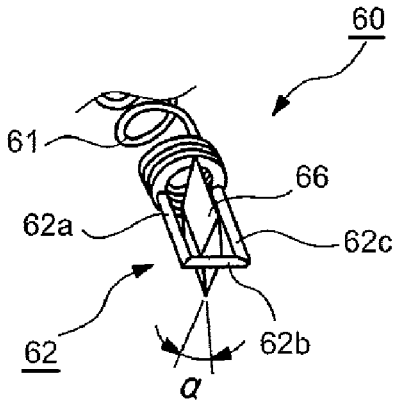
FIG. 17 is a cubic diagram showing an end portion of a conveyance spiral in a transformation example of embodiment 2 of the present invention.

FIG. 16 is a cubic diagram showing a main part of an image forming unit 16Bk in a transformation example of embodiment 2 of the present invention; and FIG. 17 is a cubic diagram showing an end portion of a conveyance spiral 60 in a transformation example of embodiment 2 of the present invention.

In the transformation example, a board shape member 66, as a rotation supply member, also as a developer pushing member, has a diamond-shaped cross section; a vertical angle at the side of acute angle, is "α". Moreover, not only is it possible to form the board shape member 66 to have a diamond-shaped cross section, but also it is possible to form the board shape member 66 to have a cross section of parallelogram. As sending planes, at sides of obtuse angle of the board shape member 66, slant surfaces are formed to respectively face to the first straight line part 62*a* and the third straight line part 62*c*, and to respectively slant with respect to the second straight line part 62*b*.

Next is to explain operation of the conveyance spiral 60 serving as a first conveyance member.

Figure 18:
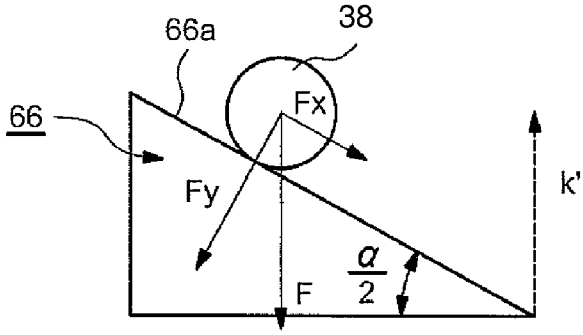
FIG. 18 is a diagram for explaining a function of a conveyance spiral in a transformation example of embodiment 2 of the present invention.
Figure 19:
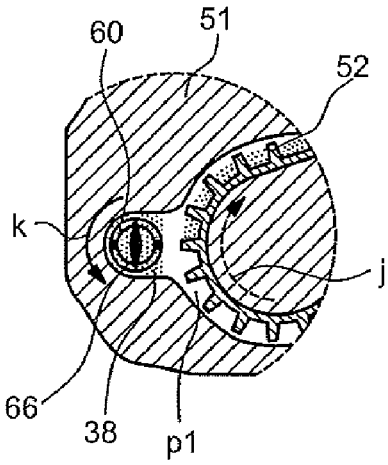
FIG. 19 is a first diagram showing operation of a conveyance spiral in a transformation example of embodiment 2 of the present invention.
Figure 20:
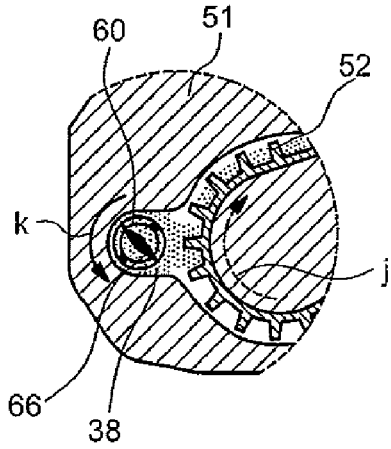
FIG. 20 is a second diagram showing operation of a conveyance spiral in a transformation example of embodiment 2 of the present invention.
Figure 21:
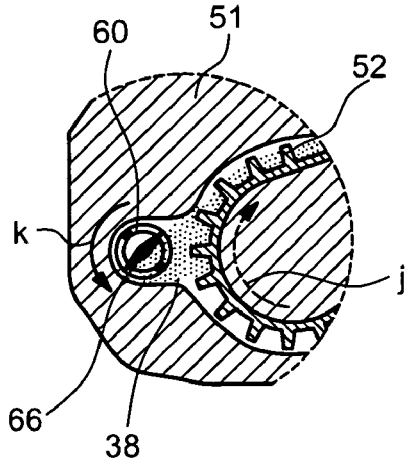
FIG. 21 is a third diagram showing operation of a conveyance spiral in a transformation example of embodiment 2 of the present invention.

FIG. 18 is a diagram for explaining a function of a conveyance spiral 60 in a transformation example of embodiment 2 of the present invention; FIG. 19 is a first diagram showing operation of a conveyance spiral 60 in a transformation example of embodiment 2 of the present invention; FIG. 20 is a second diagram showing operation of a conveyance spiral 60 in a transformation example of embodiment 2 of the present invention; and FIG. 21 is a third diagram showing operation of a conveyance spiral 60 in a transformation example of embodiment 2 of the present invention.

In the case, when the conveyance spiral 60 rotates along a direction of an arrow "k'", accompanying with the rotation of the conveyance spiral 60, the waste toner 38 is pushed by the conveyance spiral 60 in a force F along a direction that is converse with the rotation direction "k'". At that time, as shown by FIG. 18, because slant surface 66*a* of the board shape member 66 slants at an angle of "a", the force F is divided into a component force Fx that is parallel with the slant surface 66*a* and a component force Fy that is perpendicular to the slant surface 66*a*. Through the component force Fx, the waste toner 38 is pushed to the side of the conveyance belt 52 serving as second conveying member. Therefore, it is possible to increase a force to send the waste toner 38 into the conveyance belt 52. Moreover, in the transformation example, the angle of "α" is set into:

$$5° \leqq \alpha/2 \leqq 45°;$$

It is desirable to be set into:

$$15° \leqq \alpha/2 \leqq 25°.$$

Thus, in the transformation example, because the slant surface 66*a* of the board shape member 66 slants, in the conveying section p1, it is possible to effectively send the waste toner 38 into the side of the conveyance belt 52.

Embodiment 3

Next is to explain embodiment 3. Moreover, regarding the same component as that in embodiments 1 and 2, the same symbol will be assigned; regarding the same effect of the present invention, obtained by a same structure, it will be applied as an effect of embodiment.

Figure 22:
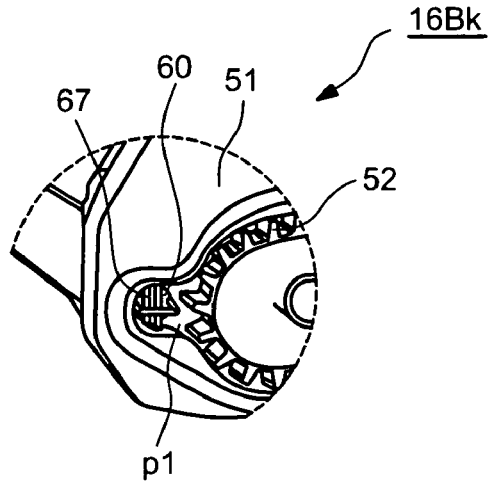
FIG. 22 is a cubic diagram showing a main part of an image forming unit in embodiment 3 of the present invention.
Figure 23:
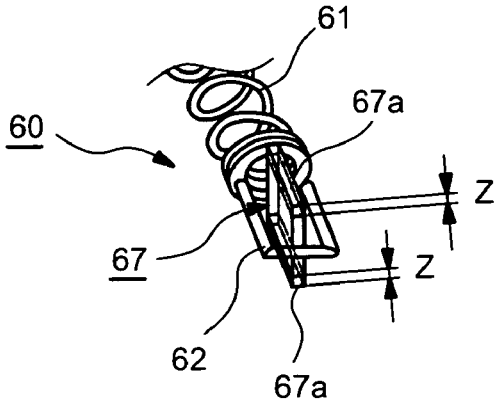
FIG. 23 is a cubic diagram showing an end portion of a conveyance spiral in embodiment 3 of the present invention.
Figure 24:
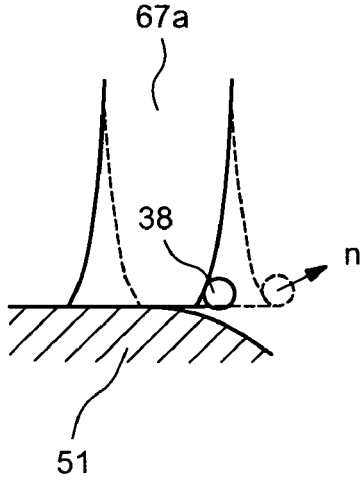
FIG. 24 is a diagram for explaining a function of a conveyance spiral in embodiment 3 of the present invention.
Figure 25:
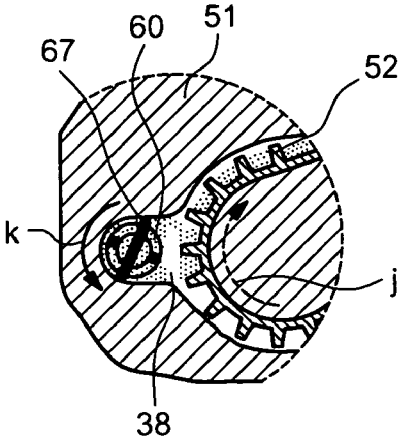
FIG. 25 is a first diagram showing operation of a conveyance spiral in embodiment 3 of the present invention.
Figure 26:
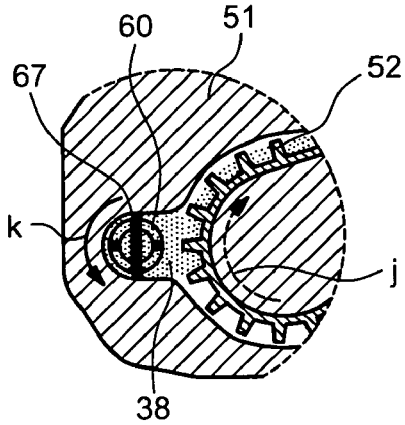
FIG. 26 is a second diagram showing operation of a conveyance spiral in embodiment 3 of the present invention.
Figure 27:
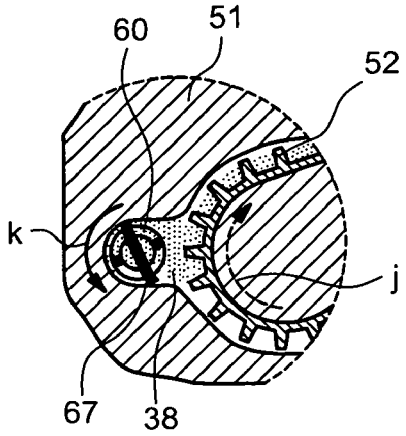
FIG. 27 is a third diagram showing operation of a conveyance spiral in embodiment 3 of the present invention.

FIG. 22 is a cubic diagram showing a main part of an image forming unit 16Bk in embodiment 3 of the present invention; FIG. 23 is a cubic diagram showing an end portion of a conveyance spiral 60 in embodiment 3 of the present invention; FIG. 24 is a diagram for explaining a function of a conveyance spiral 60 in embodiment 3 of the present invention; FIG. 25 is a first diagram showing operation of a conveyance spiral 60 in embodiment 3 of the present invention; FIG. 26 is a second diagram showing operation of a conveyance spiral 60 in embodiment 3 of the present invention; and FIG. 27 is a third diagram showing operation of a conveyance spiral 60 in embodiment 3 of the present invention.

In the embodiment, a board shape member 67, as a rotation supply member, also as a developer pushing member, is formed from an elastic body. By comparing with embodiment 2, edge portions 67*a*, as end portions of the board shape member 67, are respectively increased by a length "z" along a width direction, and respectively project from the conveyance spiral 60 serving as first conveying member, so that the side frame 51 is contacted partly. Moreover, the board shape member 67 is formed by an elastic body having a bendy character, such as urethane rubber or the like.

When the edge portions 67*a* contact to the side frame 51, as shown by solid line in FIG. 24, the board shape member 67 bends through an interference of the side frame 51. With a rotation of the board shape member 67, when the edge portions 67*a* reach positions where the edge portions 67*a* do not contact with the side frame 51, as shown by broken line in FIG. 24, the interference of the side frame 51 loses, the board shape member 67 is liberated to send the waste toner 38 to the side of the conveyance belt 52 serving as a second conveying member, by a force indicated by "n" through an elasticity.

Moreover, when the board shape member 67 does not bend, if a distance from a rotation center of the board shape member 67 to the edge portion 67*a* is set into "a1"; a distance from a rotation center of the board shape member 67 to the position where the side frame 51 is contacted partly is set into "a2"; and a difference between the distance "a1" and the distance "a2" is set into "Δϵ", in the embodiment, the difference "Δϵ" is:

$$0.2\ \text{mm} \leqq \Delta\epsilon \leqq 2\ \text{mm},$$

It is desirable to be:

$$0.5\ \text{mm} \leqq \Delta\epsilon \leqq 1\ \text{mm}.$$

As stated above, in the embodiment, because the board shape member 67 is formed from an elastic body and a width of the board shape member 67 is increased, through using an interference of the side frame 51 and through an elasticity, it is possible to effectively send the waste toner 38 into the side of the conveyance belt 52.

Further, because the waste toner 38 adhering to the wall of the side frame 51 can be scraped by the board shape member 67, it is possible to prevent the waste toner 38 from solidifying in the conveying section p1.

Embodiment 4

Next is to explain embodiment 4. Moreover, regarding the same component as that in embodiments 1, 2 and 3, the same symbol will be assigned; regarding the same effect of the present invention, obtained by a same structure, it will be applied as an effect of embodiment.

Figure 28:
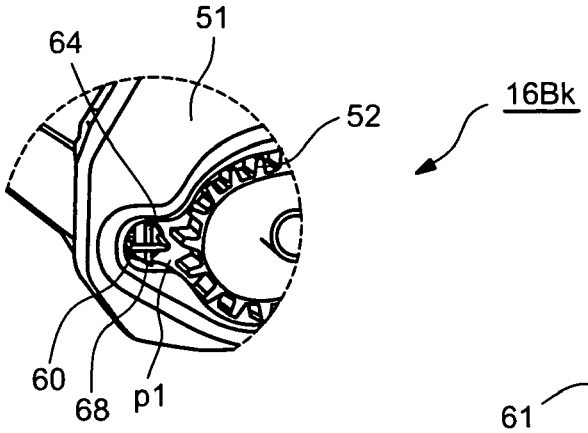
FIG. 28 is a cubic diagram showing a main part of an image forming unit in embodiment 4 of the present invention.
Figure 29:
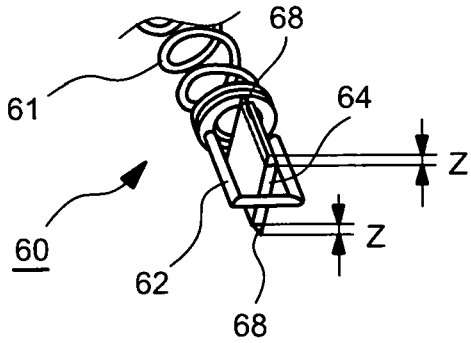
FIG. 29 is a cubic diagram showing an end portion of a conveyance spiral in embodiment 4 of the present invention.
Figure 30:
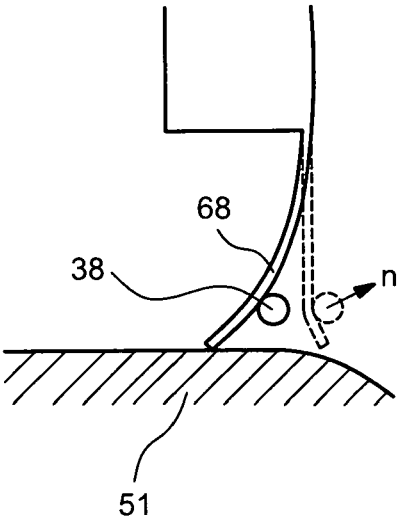
FIG. 30 is a diagram for explaining a function of a conveyance spiral in embodiment 4 of the present invention.
Figure 31:
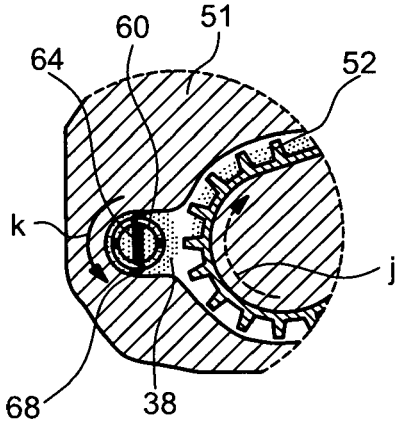
FIG. 31 is a first diagram showing operation of a conveyance spiral in embodiment 4 of the present invention.
Figure 32:
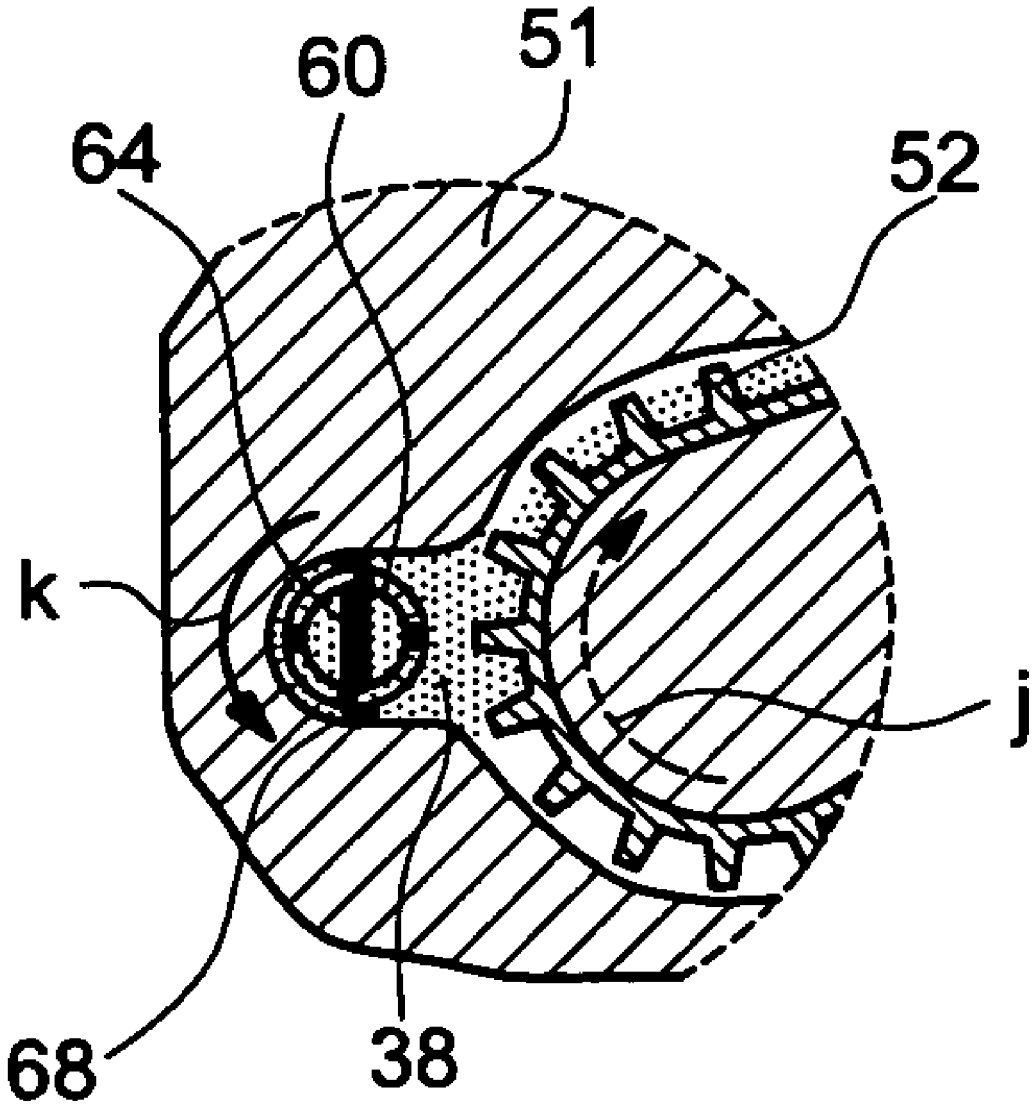
FIG. 32 is a second diagram showing operation of a conveyance spiral in embodiment 4 of the present invention.

FIG. 28 is a cubic diagram showing a main part of an image forming unit 16Bk in embodiment 4 of the present invention; FIG. 29 is a cubic diagram showing an end portion of a conveyance spiral 60 in embodiment 4 of the present invention; FIG. 30 is a diagram for explaining a function of a conveyance spiral 60 in embodiment 4 of the present invention; FIG. 31 is a first diagram showing operation of a conveyance spiral 60 in embodiment 4 of the present invention; and FIG. 32 is a second diagram showing operation of a conveyance spiral 60 in embodiment 4 of the present invention.

In the embodiment, on two edges of a board shape member 64 that serves as a rotation supply member, also serves as a developer pushing member, films 68 with a length "z" are respectively stuck, and the films 68 partly contact with the side frame 51. When the films 68 contact to the side frame 51, as shown by solid line in FIG. 30, the films 68 bend through an interference of the side frame 51. With a rotation of the board shape member 64, when the films 68 reach positions where the films 68 do not contact with the side frame 51, as shown by broken line in FIG. 30, the interference of the side frame 51 loses, the films 68 are liberated to send the waste toner 38 to the side of the conveyance belt 52, by a force indicated by "n" through an elasticity.

The film 68 is formed from material having elasticity, for example, the film 68 is formed from PET resin, when a thickness of the film 68 is set into "d", in the embodiment, the thickness "d" is:

$$0.01\ \text{mm} \leqq d \leqq 0.5\ \text{mm},$$

It is desirable to be:

$$0.05\ \text{mm} \leqq d \leqq 0.1\ \text{mm}.$$

Further, if a distance from a rotation center of the board shape member 64 to an edge portion that is a tip portion of the board shape member 64 is set into "a3"; a distance from the root of the film 68 which does not bend to a tip portion is set into "h"; and a distance from a rotation center of the board shape member 64 to the position where the film 68 partly contacts with the side frame 51 is set into "a4", the distance "a3" is shortened by 0.5 mm than the distance "a4", and the distance "h" is:

$$0.5\ \text{mm} \leqq h \leqq 1\ \text{mm}.$$

As stated above, in the embodiment, because the films 68 are stuck on the two edges of the board shape member 64, through using an interference of the side frame 51 and through an elasticity, it is possible to effectively send the waste toner 38 into the side of the conveyance belt 52.

Further, because the waste toner 38 adhering to the wall of the side frame 51 can be scraped by the board shape member 67, it is possible to prevent the waste toner 38 from solidifying in the conveying section p1. Furthermore, because what to contact with the side frame 51 is the film 68, it is possible to decrease resistance caused by contact.

The Utilization Possibility in Industry:

In the respective embodiments, the present invention is applied to a printer. However, the present invention also can be applied to such image forming apparatus as copying apparatus, facsimile apparatus, multi-function apparatus and the like.

The present invention is not limited to the foregoing embodiment or example but many modifications and variations are possible within the spirit and scope of the appended claims of the invention.

What is claimed is:

1. An image forming unit, comprising:

an image carrying body;

a cleaning member which is furnished along the image carrying body to remove developer remaining on the surface of the image carrying body after transferring;

a first conveying member which conveys the developer removed by the cleaning member to a conveying section formed on one end of the image forming unit, as waste developer; and a second conveying member which conveys the waste developer conveyed from the conveying section to a waste developer collecting section, wherein the first conveying member has a developer pushing section which changes a conveyance direction in the conveying section and conveys the waste developer toward the second conveying member.

2. The image forming unit according to claim 1, wherein the developer pushing section is a developer pushing member and is unified with the first conveying member.

3. The image forming unit according to claim 2, wherein the developer pushing member is formed from a bended extension portion of the first conveying member, the developer pushing member has a rectangle shape with a space part.

4. The image forming unit according to claim 1, wherein the first conveying member is formed in a spiral shape.

5. The image forming unit according to claim 1, wherein the developer pushing section includes a first developer pushing member which is unified with the first conveying member; and a second developer pushing member which has sending planes to send the waste developer to the second conveying member.

6. The image forming unit according to claim 5, wherein the first developer pushing member is formed from a bended extension portion of the first conveying member, the first developer pushing member has a rectangle shape with a space part.

7. The image forming unit according to claim 6, wherein the second developer pushing member is furnished in the space part.

8. The image forming unit according to claim 5, wherein the second developer pushing member is a board shape member.

9. The image forming unit according to claim 5, wherein the sending plane is formed to face to the first developer pushing member in the developer pushing section.

10. The image forming unit according to claim 5, wherein the second developer pushing member is a diamond-shaped member, and is rotated with a rotation of the first conveying member;

the sending planes are formed from the surfaces of the diamond-shaped member.

11. The image forming unit according to claim 5, wherein the second developer pushing member is formed from an elastic body, the tip end of the second developer pushing member partly contacts with a box body in the conveying section.

12. The image forming unit according to claim 5, wherein film is stuck on the tip end of the second developer pushing member, the film partly contacts with a box body in the conveying section.

13. An image forming apparatus, comprising:

an image forming unit, wherein the image forming unit includes:

an image carrying body;

a cleaning member which is furnished along the image carrying body to remove developer remaining on the surface of the image carrying body after transferring;

a first conveying member which conveys the developer removed by the cleaning member to a conveying section formed on one end of the image forming unit, as waste developer; and a second conveying member which conveys the waste developer conveyed from the conveying section to a waste developer collecting section, wherein the first conveying member has a developer pushing section which changes a conveyance direction in the conveying section and conveys the waste developer toward the second conveying member.

* * * * *